US009032934B2

(12) United States Patent
Nakamura et al.

(10) Patent No.: US 9,032,934 B2
(45) Date of Patent: May 19, 2015

(54) FUEL INJECTION VALVE SUPPORTING STRUCTURE

(71) Applicant: KEIHIN CORPORATION, Shinjuku-Ku, Tokyo (JP)

(72) Inventors: Nakaya Nakamura, Tochigi (JP); Manabu Wakamatsu, Tochigi (JP); Keisuke Machida, Tochigi (JP); Akira Arioka, Tochigi (JP)

(73) Assignee: Keihin Corporation, Tokyo (JP)

( * ) Notice: Subject to any disclaimer, the term of this patent is extended or adjusted under 35 U.S.C. 154(b) by 54 days.

(21) Appl. No.: 13/767,085

(22) Filed: Feb. 14, 2013

(65) Prior Publication Data

US 2013/0220276 A1 Aug. 29, 2013

(30) Foreign Application Priority Data

Feb. 27, 2012 (JP) ..... 2012-040731

(51) Int. Cl.
*F02M 61/14* (2006.01)
*F02M 69/04* (2006.01)
*F02M 55/02* (2006.01)

(52) U.S. Cl.
CPC ..... *F02M 69/04* (2013.01); *F02M 55/025* (2013.01); *F02M 61/14* (2013.01);
(Continued)

(58) Field of Classification Search
CPC ..... F02M 61/14; F02M 61/12; F02M 61/145; F02M 2200/852–2200/858; F02M 2200/8023; F02M 2200/16
USPC ..... 123/468, 469, 470; 285/406, 415, 364, 285/424, 24, 26, 27
See application file for complete search history.

(56) References Cited

U.S. PATENT DOCUMENTS 2,365,785 A * 12/1944 Tinnerman ..... 248/56
4,993,390 A * 2/1991 Ono et al. ..... 123/470
(Continued)

FOREIGN PATENT DOCUMENTS

DE 10163030 A1 * 7/2003
EP 1892408 A1 * 2/2008
(Continued)

OTHER PUBLICATIONS

Official Communications dated Dec. 31, 2014 issued in the corresponding Chinese Patent Application 2013100596602.
(Continued)

*Primary Examiner* — Stephen K Cronin
*Assistant Examiner* — Brian Kirby
(74) *Attorney, Agent, or Firm* — Carrier Blackman & Associates, P.C.; Joseph P. Carrier; Fulchand P. Shende

(57) ABSTRACT

In a fuel injection valve supporting structure, a first contact surface being orthogonal to a center axis of a fuel injection valve and opposed to a fuel supply cap and paired second contact surfaces opposed to each other with a plane, including the center axis and a center line of a coupler, in between are formed in an intermediate portion of the fuel injection valve, and a supporting member includes: a base plate set on the first contact surface; an elastic piece extending from the base plate to elastically come into pressure contact with the fuel supply cap and bias the fuel injection valve toward an injection valve attachment hole by its reaction force; and paired turn stopper pieces each extending from the base plate to abut against the second contact surface and restrict a turn of the fuel injection valve about the center axis.

10 Claims, 4 Drawing Sheets

(52) U.S. Cl.
CPC ..... *F02M 2200/26* (2013.01); *F02M 2200/852* (2013.01); *F02M 2200/853* (2013.01); *F02M 2200/856* (2013.01); *F02M 2200/857* (2013.01)

(56) References Cited

U.S. PATENT DOCUMENTS

| | | | | | |
|---|---|---|---|---|---|
| 5,074,269 | A * | 12/1991 | Herbon et al. | ..... | 123/470 |
| 5,136,999 | A * | 8/1992 | Bassler et al. | ..... | 123/470 |
| 5,394,850 | A * | 3/1995 | Murphy et al. | ..... | 123/470 |
| 5,803,052 | A * | 9/1998 | Lorraine et al. | ..... | 123/470 |
| 5,820,168 | A * | 10/1998 | De Giacomoni | ..... | 285/192 |
| 5,893,351 | A * | 4/1999 | Akutagawa et al. | ..... | 123/470 |
| 5,970,953 | A * | 10/1999 | Lorraine et al. | ..... | 123/470 |
| 6,042,154 | A * | 3/2000 | Gensert et al. | ..... | 285/233 |
| 6,276,339 | B1 * | 8/2001 | Shebert et al. | ..... | 123/470 |
| 6,322,306 | B1 * | 11/2001 | Dutton | ..... | 411/121 |
| 6,481,420 | B1 * | 11/2002 | Panasuk et al. | ..... | 123/470 |
| 6,668,803 | B1 * | 12/2003 | Jasiolek et al. | ..... | 123/470 |
| 6,846,023 | B2 * | 1/2005 | Ebinger et al. | ..... | 285/420 |
| 6,863,053 | B2 * | 3/2005 | Suzuki et al. | ..... | 123/470 |
| 7,063,075 | B2 * | 6/2006 | Berger et al. | ..... | 123/470 |
| 7,210,462 | B2 * | 5/2007 | Scheffel et al. | ..... | 123/470 |
| 7,373,926 | B2 * | 5/2008 | Eckbauer et al. | ..... | 123/470 |
| 7,581,530 | B2 * | 9/2009 | Scheffel et al. | ..... | 123/470 |
| 7,765,984 | B2 | 8/2010 | Fuerst et al. | | |
| 7,802,559 | B2 * | 9/2010 | Furst et al. | ..... | 123/470 |
| 8,408,184 | B2 * | 4/2013 | Marc et al. | ..... | 123/470 |
| 2009/0056674 | A1 * | 3/2009 | Furst et al. | ..... | 123/470 |
| 2010/0218743 | A1 * | 9/2010 | Marc et al. | ..... | 123/470 |
| 2012/0247426 | A1 * | 10/2012 | Roseborsky et al. | ..... | 123/470 |
| 2013/0192565 | A1 * | 8/2013 | Roseborsky et al. | ..... | 123/470 |
| 2014/0231551 | A1 * | 8/2014 | Serra et al. | ..... | 239/584 |

FOREIGN PATENT DOCUMENTS

| | | | |
|---|---|---|---|
| EP | 2492489 | A1 * | 8/2012 |
| JP | 2004-245168 | A | 9/2004 |
| JP | 2010-168964 | A | 8/2010 |
| JP | 2010-168965 | A | 8/2010 |
| WO | 2006092427 | A1 | 9/2006 |

OTHER PUBLICATIONS

Official Communication dated Feb. 12, 2015 in regards to corresponding Japanese Patent Application 2012-040731.

* cited by examiner

FUEL INJECTION VALVE SUPPORTING STRUCTURE

BACKGROUND OF THE INVENTION

1. Field of the Invention

The present invention relates to an improvement of a fuel injection valve supporting structure in which: a nozzle portion at a front end portion of a fuel injection valve projectingly provided with a power supply coupler on one side surface of the fuel injection valve is fitted in an injection valve attachment hole of an engine; a fuel supply cap of a fuel distribution pipe supported by the engine is fitted on a fuel introduction portion at a rear end portion of the fuel injection valve; a supporting member for biasing the fuel injection valve toward the injection valve attachment hole is interposed between the fuel injection valve and the fuel supply cap.

2. Description of the Related Art

Such a fuel injection valve supporting structure is already known, as disclosed in Japanese Patent Application Laid-open No. 2004-245168.

With regard to such a conventional fuel injection valve supporting structure, a U-shaped plate spring as a supporting member is only interposed between a fuel injection valve and a fuel supply cap. For this reason, while an engine is in operation, the fuel injection valve is likely to turn more or less about its center axis due to the vibration of the engine. The turn changes the direction in which fuel is injected from a nozzle portion of the fuel injection valve, and adversely affects the fuel combustion condition in the engine.

SUMMARY OF THE INVENTION

The present invention has been made with the foregoing situation taken into consideration, and an object thereof is to provide the fuel injection valve supporting structure which is capable of easily restricting the turn of the fuel injection valve about the center axis.

In order to achieve the object, according to a first feature of the present invention, there is provided a fuel injection valve supporting structure in which: a nozzle portion at a front end portion of a fuel injection valve projectingly provided with a power supply coupler on one side surface of the fuel injection valve is fitted in an injection valve attachment hole of an engine; a fuel supply cap of a fuel distribution pipe supported by the engine is fitted on a fuel introduction portion at a rear end portion of the fuel injection valve; a supporting member for biasing the fuel injection valve toward the injection valve attachment hole is interposed between the fuel injection valve and the fuel supply cap, wherein a first contact surface and a pair of second contact surfaces are formed in an intermediate portion of the fuel injection valve, the first contact surface being orthogonal to a center axis of the fuel injection valve and opposed to the fuel supply cap, the pair of second contact surfaces opposed to each other with a plane in between, the plane including the center axis and a center line of the coupler, and the supporting member includes a base plate, an elastic piece and a pair of turn stopper pieces, the base plate set on the first contact surface, the elastic piece extending from the base plate to elastically come into pressure contact with the fuel supply cap and bias the fuel injection valve toward the injection valve attachment hole by means of reaction force produced by the pressure contact, each turn stopper piece extending from the base plate to come into contact with the second contact surface and restrict a turn of the fuel injection valve about the center axis.

With the first feature of the present invention, when the supporting member is inserted between the first contact surface of the fuel injection valve and the fuel supply cap from an outside of the fuel injection valve, which is on an opposite side from the coupler, the base plate is set on the first contact surface; the elastic piece elastically comes into pressure contact with a front end surface of the fuel supply cap; and the reaction force produced by the pressure contact presses the base plate against the first contact surface. For these reasons, the fuel injection valve can be elastically held between and by the engine and the fuel supply cap, and thus it is possible to prevent the fuel injection valve from moving in the axial direction. Concurrently, since the pair of turn stopper pieces of the supporting member come into contact with the pair of second contact surfaces on the two sides of the fuel injection valve while sliding over the pair of second contact surfaces in a way that the pair of second contact surfaces are held between and by the pair of turn stopper pieces, it is possible to prevent the turn of the fuel injection valve about its center axis. Thereby, it is possible to stabilize a direction in which fuel is injected from the nozzle portion.

According to a second feature of the present invention, in addition to the first feature, the pair of turn stopper pieces are provided with elasticity for making the pair of turn stopper pieces elastically come into contact with the pair of second contact surfaces, respectively.

With the second feature of the present invention, since the pair of turn stopper pieces elastically come into pressure contact with the pair of second contact surfaces of the fuel injection valve, it is possible to inhibit the rotational vibration of the fuel injection valve.

According to a third feature of the present invention, in addition to the first feature, the second contact surfaces are formed on an outer peripheral surface of a portion whose outer diameter is the largest in the fuel injection valve.

With the third feature of the present invention, since the second contact surfaces are formed on the outer peripheral surface of the portion whose outer diameter is the largest in the fuel injection valve, it is possible to prevent the turn of the fuel injection valve by means of relatively small contact force which is applied to the second contact surfaces by the turn stopper pieces, and accordingly to more stabilize the direction in which the fuel is injected from the nozzle portion.

According to a fourth feature of the present invention, in addition to the first feature, the base plate includes a U-shaped cutout which receives the fuel injection valve when the supporting member is attached to the fuel injection valve, a pair of the elastic pieces which are arranged side-by-side with a space in between are provided, the fuel injection valve being received by the space, and a tip end portion of each of the turn stopper pieces which is in front in a direction in which the supporting member is attached to the fuel injection valve is bent outwards.

With the fourth feature of the present invention, since the base plate is set on the first contact surface with the fuel introduction portion received by the U-shaped cutout in a center portion of the base plate, a larger area can be secured for the placement of the base plate on the first contact surface. In addition, since the pair of elastic pieces extending from one end of the base plate elastically come into pressure contact with a front end surface of the fuel supply cap while receiving the fuel introduction portion between the pair of elastic pieces, reaction force produced by the press of the elastic pieces against the fuel supply cap can be made to work on the fuel injection valve along the center axis of the fuel injection valve. Accordingly, the fuel injection valve can be stably supported without being tilted. Furthermore, when the supporting member is attached to the fuel injection valve, the outwardly-curved tip end portion of each turn stopper piece exerts a guidance function of guiding the corresponding second contact surface to a center portion of the turn stopper piece. Accordingly, the center portion of each turn stopper piece can be smoothly set at a predetermined position on the corresponding second contact surface. Moreover, a slidable surface of the turn stopper piece over which the second contract surface slides is smooth, and it is accordingly possible to prevent the second contact surface from being damaged.

According to a fifth feature of the present invention, in addition to the first feature, a third contact surface in parallel with the center axis is formed on an outer side surface of the fuel supply cap, and a positioning piece for restricting a position of the supporting member about the center axis by coming into contact with the third contact surface is formed to extend from the base plate.

With the fifth feature of the present invention, when the positioning piece of the supporting member comes into contact with the third contact surface of the fuel supply cap, each turn stopper piece comes into contact with the corresponding second contact surface, and a position of the fuel injection valve about its center axis with respect to the fuel supply cap is restricted. Accordingly, the fuel injection valve can be stabilized at the position.

The above and other objects, characteristics and advantages of the present invention will be clear from detailed descriptions of the preferred embodiment which will be provided below while referring to the attached drawings.

DESCRIPTIONS OF THE PREFERRED EMBODIMENT

An embodiment of the present invention will be described below based on the attached drawings.

Figure 1:
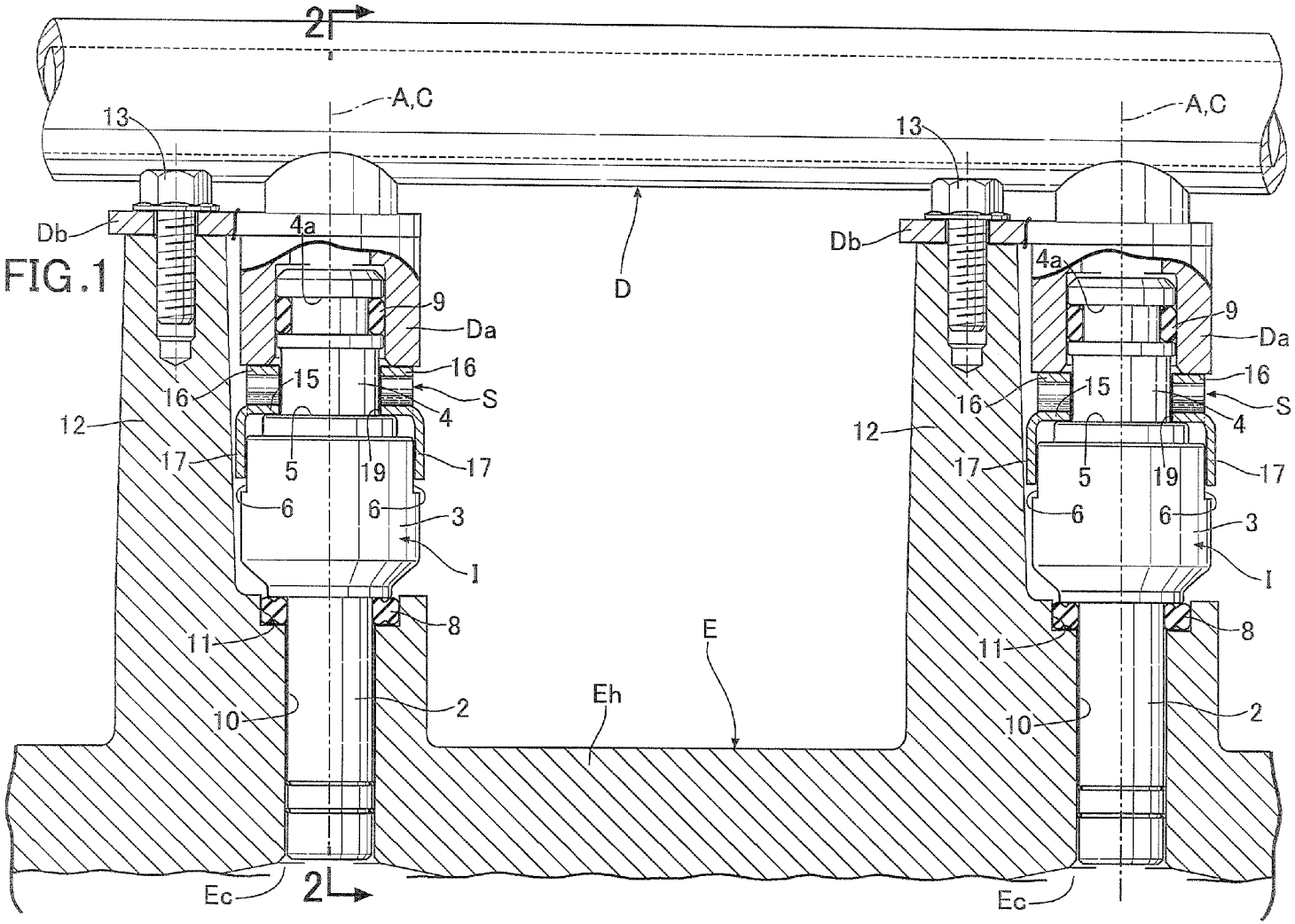
FIG. 1 is a partial longitudinal sectional front view showing a fuel injection valve supporting structure for a multi-cylinder engine according to an embodiment of the present invention.
Figure 2:
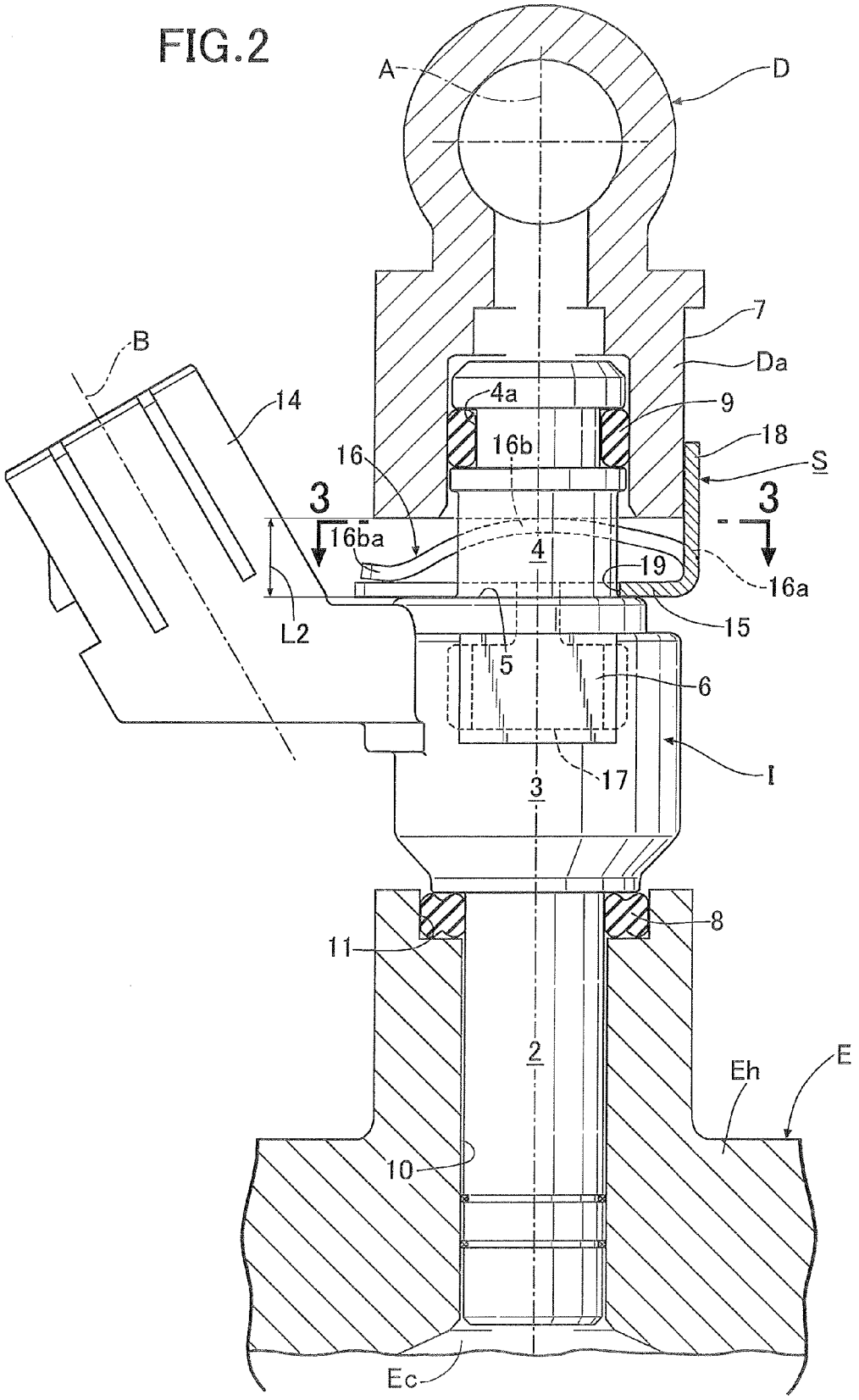
FIG. 2 is an enlarged sectional view taken along a line 2-2 in FIG. 1.

As shown in FIG. 1 and FIG. 2, first of all, multiple fuel injection valves I capable of injecting fuel to combustion chambers Ec of multiple cylinders and a fuel distribution pipe D configured to distribute the fuel to the fuel injection valves I are attached to a cylinder head Eh of a multi-cylinder engine E. In addition, a supporting member S is interposed between each fuel injection valve I and the fuel distribution pipe D in order that the fuel injection valve I should not be displaced in its axial direction or about a center axis A. Detailed descriptions of the structure will be provided hereinbelow.

Each fuel injection valve I is formed from a cylindrical nozzle portion 2, an electromagnetic coil portion 3 and a fuel introduction portion 4 which are coaxially continuous with one another from a front end toward a rear end of the fuel injection valve I. When electricity is supplied to the electromagnetic coil portion 3, the fuel injection valve I is designed to open a valve inside the nozzle portion 2, and to inject the fuel, which is introduced by the fuel introduction portion 4 from the fuel distribution pipe D, into the corresponding combustion chamber Ec.

In the fuel injection valve I, outer diameters of the nozzle portion 2, the fuel introduction portion 4, and the electromagnetic coil portion 3 are larger in this order. Accordingly, the electromagnetic coil portion 3 has the largest outer diameter. A power supply coupler 14 is integrally projectingly provided to a side surface of the electromagnetic coil portion 3. An annular seal/cushion member 8 in close contact with a front end surface of the electromagnetic coil portion 3 is attached to an outer periphery of the nozzle portion 2. An O-ring 9 is attached to a seal groove 4*a* in an outer periphery of the fuel introduction portion 4.

An annular and flat first contact surface 5 facing the fuel introduction portion 4 side is formed in a boundary portion between the electromagnetic coil portion 3 and the fuel introduction portion 4. A pair of flat second contact surfaces 6, 6 opposed to each other with a plane C interposed in between is formed of a cutout-shape in an outer peripheral surface of the electromagnetic coil portion 3. In this respect, the plane C includes the center axis A of the fuel injection valve I and a center line B of the coupler 14.

Meanwhile, each cylinder head Eh is provided with: an injection valve attachment hole 10 whose inner end is opened to a ceiling surface of the corresponding combustion chamber Ec; and an annular recessed portion 11 surrounding an outer opening end of the injection valve attachment hole 10. The nozzle portion 2 of the fuel injection valve I is fitted in the injection valve attachment hole 10, and the seal/cushion member 8 is housed in the recessed portion 11.

Furthermore, the fuel distribution pipe D is placed along a direction in which the multiple cylinders of the engine E are arranged. The fuel is designed to be delivered with pressure from an end of the fuel distribution pipe D by means of a fuel pump, which is not illustrated. Multiple fuel supply caps Da which are arranged coaxial with the multiple fuel injection valves I fitted in the multiple injection valve attachment holes 10 are projectingly provided to one side surface of the fuel distribution pipe D. Each fuel supply cap Da is fitted on the outer periphery of the fuel introduction portion 4 of the corresponding fuel injection valve I. At this time, the O-ring 9 is in close contact with an inner peripheral surface of the fuel supply cap Da. A flat third contact surface 7 in parallel with the center axis A of the corresponding fuel injection valve I is formed on an outer side surface of each fuel supply cap Da. A bracket Db is fixedly provided to a base portion of each fuel supply cap Da. The bracket Db is fixedly attached to a support column 12 by a bolt 13, the support column 12 being provided upright on an upper surface of the cylinder head Eh.

Figure 3:
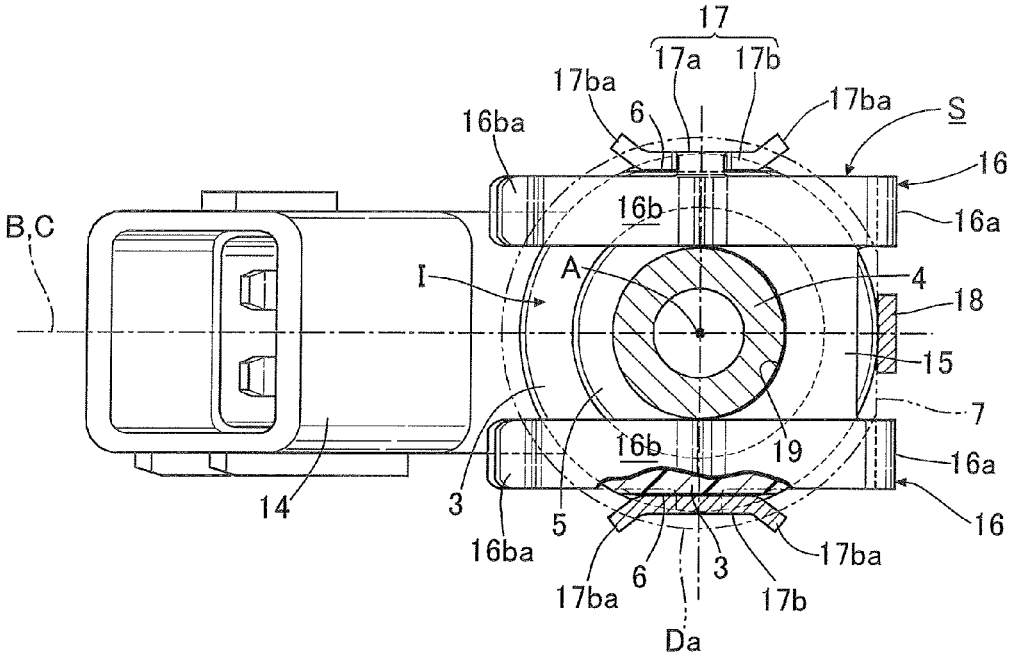
FIG. 3 is a sectional view taken along a line 3-3 in FIG. 2.
Figure 4:
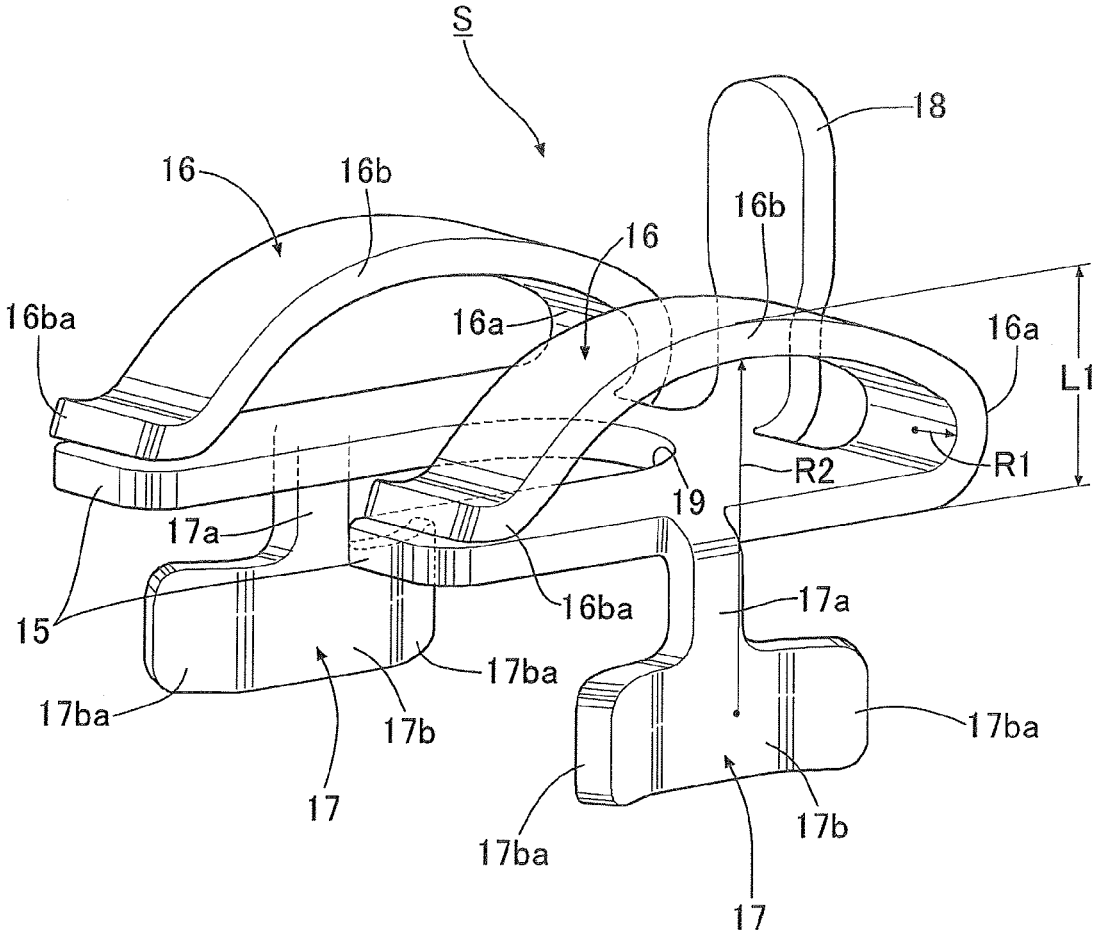
FIG. 4 is a perspective view independently showing a supporting member which has been shown in the other drawings.

As shown in FIG. 2 to FIG. 4, the supporting member S is made by pressing a steel plate, and includes a base plate 15, elastic pieces 16, turn stopper pieces 17, and a positioning piece 18.

The base plate 15 is set while overlapping the first contact surface 5. A U-shaped cutout 19 capable of receiving the fuel introduction portion 4 of the fuel injection valve I is provided in a center portion of the base plate 15. The pair of elastic pieces 16 capable of elastically coming into pressure contact with a front end surface of the corresponding fuel supply cap Da are formed in one end, which is an opposite side from the U-shaped cutout 19, of the base plate 15, so as to be integrally connected. The two elastic pieces 16 are arranged with a space capable of receiving the fuel introduction portion 4 of the corresponding fuel injection valve I therebetween.

Each elastic piece 16 is formed from: a first elastic portion 16*a* extending upwards from the one end of the base plate 15, and bent like the letter U lying horizontally; and a second elastic portion 16*b* extending towards the other end of the base plate 15 while curving upwards from the first elastic portion 16*a*, and bringing a tip end portion 16*ba* thereof into pressure contact with an upper surface of the base plate 15. A curvature radius R2 of the second elastic portion 16*b* is set sufficiently larger than a curvature radius R1 of the first elastic portion 16*a* (see FIG. 4).

Further, while each elastic piece 16 is set free, a distance L1 (see FIG. 4) from an apex of the second elastic portion 16*b* to an undersurface of the base plate 15 is set larger than a distance L2 (see FIG. 2) from the first contact surface 5 to the front end surface of the fuel supply cap Da. For this reason, once the base plate 15 and the elastic pieces 16 are inserted between the first contact surface 5 and the fuel supply cap Da, each elastic piece 16 can elastically come into pressure contact with the front end surface of the fuel supply cap Da while bending the first and second elastic portions 16*a*, 16*b*. While the first and second elastic portions 16*a*, 16*b* are bending, the tip end portion 16*ba* of the corresponding second elastic portion 16*b* is capable of sliding over the upper surface of the base plate 15. The tip end portion 16*ba* is formed in a way that curves upwards to smoothen the sliding thereof.

The pair of turn stopper pieces 17 are integrally connected to two outer side surfaces of the base plate 15, respectively. Each turn stopper piece 17 formed in the shape of the letter T which is turned upside down includes: a vertical portion 17*a* extending downwards from the corresponding outer side surface of the base plate 5 in a bending manner; and a horizontal portion 17*b* extending from a lower end of the vertical portion 17*a* along the U-shaped cutout 19. The pair of turn stopper pieces 17 are capable of holding the electromagnetic coil portion 3 between and by the pair of turn stopper pieces 17 while bringing their horizontal portions 17*b* into contact with the respective second contact surfaces 6. Elasticity for biasing the horizontal portions 17*b* inwards is given to roots of the respective vertical portions 17*a* to make the pair of turn stopper pieces 17 elastically hold the electromagnetic coil portion 3 between and by the pair of turn stopper pieces 17. Moreover, two end portions 17*ba* of each horizontal portion 17*b* are formed in a way that curves outwards.

What is more, the positioning piece 18 vertically standing upwards from an interstice between the pair of elastic pieces 16 is integrally connected to the one end of the base plate 15. The positioning piece 18 is capable of coming into contact with the third contact surface 7 of the fuel supply cap Da.

Next, descriptions will be provided for operations of the embodiment.

When the fuel injection valves I are attached to the engine E, first of all, the fuel supply caps Da of the fuel distribution pipe D are fitted on the fuel introduction portions 4 of the fuel injection valves I, respectively. Subsequently, an assembled body including the fuel distribution pipe D, the fuel injection valves I and the supporting members S is made up by inserting each supporting member S between the first contact surface 5 of the corresponding fuel injection valve I and the corresponding fuel supply cap Da from an outside of the fuel injection valve I, which is on an opposite side from the coupler 14, while putting an opening portion of the U-shaped cutout 19 of the corresponding base plate 15 in the front.

Thereafter, the nozzle portions 2 of the fuel injection valves I of the assembled body are inserted into the injection valve attachment holes 10 of the cylinder head Eh, respectively. The seal/cushion members 8 in close contact with the front end surfaces of the electromagnetic coil portions 3 are housed in the recessed portions 11, respectively. Afterward, the brackets Db are fixedly attached to the support columns 12 of the cylinder head Eh by the bolts 13, while adding compression load to the support members S, respectively.

In each supporting member S, the base plate 15 is set on the first contact surface 5 with the fuel introduction portion 4 of the fuel injection valve I received by the U-shaped cutout 19, and concurrently the pair of elastic pieces 16 elastically bring the apexes of the second elastic portions 16*b* into pressure contact with the front end surface of the fuel supply cap Da by bending the first and second elastic portions 16*a*, 16*b*, while receiving the fuel introduction portion 4 between the elastic pieces 16. Reaction force produced by the pressure contact presses the base plate 15 against the first contact surface 5. Thus, the fuel injection valve I is elastically held between and by the cylinder head Eh and the fuel supply cap Da with the supporting member S and the seal/cushion member 8 interposed between the cylinder head Eh and the fuel supply cap Da.

Moreover, since the base plate 15 is set on the first contact surface 5 with the fuel introduction portion 4 received by the U-shaped cutout 19 situated in the center portion of the base plate 15, a larger area can be secured for the placement of the base plate 15 on the first contact surface 5. In addition, since the pair of elastic pieces 16 extending from the one end of the base plate 15 elastically come into contact with the front end surface of the fuel supply cap Da while receiving the fuel introduction portion 4 between the pair of elastic pieces 16, the reaction force produced by the press of the elastic pieces 16 against the fuel supply cap Da can be made to work on the fuel injection valve I along the center axis A of the fuel injection valve I. Accordingly, the fuel injection valve I can be stably supported without being tilted.

The supporting member S is inserted into the interstice between the first contact surface 5 and the fuel supply cap Da until the fuel introduction portion 4 comes into contact with an inner end of the U-shaped cutout 19. During the insertion, while sliding over the second contact surfaces 6 of the two sides of the electromagnetic coil portion 3, the horizontal portions 17*b* of the pair of turn stopper pieces 17 of the supporting member S are elastically in contact with the second contact surfaces 6 thereof in a way that the second contact surfaces 6 are held between and by the horizontal portions 17*b*. In this respect, since the two end portions 17*ba* of each turn stopper piece 17 are each formed in the outwardly-curved shape, the outwardly-curved surfaces of the two end portions 17*ba* exert a guidance function of guiding the corresponding one of the second contact surfaces 6 to a center portion of the horizontal portion 17. For this reason, the center portions of the horizontal portions 17*b* can be smoothly set into predetermined positions on the second contact surfaces 6, respectively. In addition, the slidable surfaces of the horizontal portions 17*b* over which the second contact surfaces 6 slide are smooth, and accordingly cause the second contact surfaces 6 no damage. Furthermore, when the supporting member S is detached from the fuel injection valve I, the two end portions 17*ba* of each horizontal portion 17*b* cause the corresponding one of the second contact surfaces 6 no damage, either. Moreover, since the horizontal portions 17*b* come into pressure contact with the second contact surfaces 6 by means of the elasticity of the vertical portions 17*a*, it is possible to inhibit the rotational vibration of the fuel injection valve I.

What is more, since the pair of turn stopper pieces 17 come into contact with the pair of second contact surfaces 6 formed on the outer periphery of the electromagnetic coil portion 3 whose outer diameter is the largest in the fuel injection valve I, it is possible to prevent the turn of the fuel injection valve I by means of relatively small contact force, and accordingly to stabilize the direction in which the fuel is injected from the nozzle portion 2.

When the fuel introduction portion 4 comes into contact with the inner end of the U-shaped cutout 19, the positioning piece 18 of the supporting member S almost simultaneously comes into contact with the third contact surface 7 of the fuel supply cap Da. This contact and the contact of the turn stopper pieces 17 with the respective second contact surfaces 6 restrict the position of the fuel injection valve I about the center axis A of the fuel injection valve I with respect to the fuel supply cap Da. Accordingly, the fuel injection valve I becomes stable at the position.

In addition, each elastic piece 16 is formed from: the first elastic portion 16*a* connected to the one end portion of the base plate 15, and having the smaller curvature radius R1; and the second elastic portion 16*b* extending from the first elastic portion 16*a*, making the tip end portion 16*ba* slidably come into contact with the upper surface of the other end portion of the base plate 15, and having the larger curvature radius R2. For this reason, the second elastic portion 16*b* is supported by the base plate 15 via both the tip end portion 16*ba* and the first elastic portion 16*a*. Accordingly, even though the first elastic portion 16*a* may plastically deform (in general, a portion curved with a small curvature radius tends to plastically deform easily), the elastic force of the second elastic portion 16*b* maintains each elastic piece 16's biasing function of biasing the fuel supply cap Da. Moreover, since the curvature radius R2 of the second elastic portion 16*b* is set larger than the curvature radius R1 of the first elastic portion 16*a*, the height of each elastic piece 16 is minimized as much as possible, and the supporting member S can be easily attached to the narrow space between the first contact surface 5 and the fuel supply cap Da.

Although the foregoing descriptions have been provided for an embodiment of the present invention, the present invention is not limited to the embodiment. Various design changes can be made within the scope not departing from the gist of the present invention. For example, the present invention can be applied to a structure in which the fuel injection valve I is attached to an air intake system of the engine.

What is claimed is:

1. A fuel injection valve supporting structure in which: a nozzle portion at a front end portion of a fuel injection valve is fitted in an injection valve attachment hole of an engine, wherein the fuel injection valve is provided with a power supply coupler on one side surface of the fuel injection valve; a fuel supply cap of a fuel distribution pipe supported by the engine is fitted on a fuel introduction portion at a rear end portion of the fuel injection valve; a supporting member for biasing the fuel injection valve toward the injection valve attachment hole is interposed between the fuel injection valve and the fuel supply cap, wherein a first contact surface and a pair of second contact surfaces are formed in an intermediate portion of the fuel injection valve, the first contact surface being orthogonal to a center axis of the fuel injection valve and opposed to the fuel supply cap, the pair of second contact surfaces opposed to each other with a plane in between, the plane including the center axis and a center line of the coupler, and the supporting member includes a base plate, an elastic piece and a pair of turn stopper pieces, the base plate set on the first contact surface, the elastic piece extending from the base plate to elastically come into pressure contact with the fuel supply cap and bias the fuel injection valve toward the injection valve attachment hole by means of reaction force produced by the pressure contact, each turn stopper piece extending from the base plate to come into contact with the second contact surface and restrict a turn of the fuel injection valve about the center axis, each said turn stopper piece including a vertical portion extending downwards from a corresponding outer side surface of the base plate in a bending manner, and a horizontal portion extending laterally from a lower end of the vertical portion.

2. The fuel injection valve supporting structure of claim 1, wherein the pair of turn stopper pieces are provided with elasticity for making the pair of turn stopper pieces elastically come into contact with the pair of second contact surfaces, respectively.

3. The fuel injection valve supporting structure of claim 1, wherein the second contact surfaces are formed on an outer peripheral surface of a portion whose outer diameter is the largest in the fuel injection valve.

4. The fuel injection valve supporting structure of claim 1, wherein the base plate includes a U-shaped cutout which receives the fuel injection valve when the supporting member is attached to the fuel injection valve, a pair of the elastic pieces which are arranged side-by-side with a space in between are provided, the fuel injection valve being received by the space, and a tip end portion of each of the turn stopper pieces which is in front in a direction in which the supporting member is attached to the fuel injection valve is bent outwards.

5. The fuel injection valve supporting structure of claim 1, wherein a third contact surface in parallel with the center axis is formed on an outer side surface of the fuel supply cap, and a positioning piece for restricting a position of the supporting member about the center axis by coming into contact with the third contact surface is formed to extend from the base plate.

6. The fuel injection valve supporting structure of claim 1, wherein the horizontal portion of each of the turn stopper piece is formed as a pair of horizontal portions extending in opposite horizontal directions from the vertical portion.

7. The fuel injection valve supporting structure of claim 1, wherein the elastic piece comprises a tip end portion; a first elastic portion extending upwards from one end of the base plate; and a second elastic portion extending towards other end of the base plate while curving upwards from the first elastic portion and bringing the tip end portion thereof into pressure contact with an upper surface of the base plate; and a curvature radius of the second elastic portion is greater than a curvature radius of the first elastic portion.

8. The fuel injection valve supporting structure of claim 1, wherein each of said turn stopper pieces is formed in an inverted T-shape.

9. The fuel injection valve supporting structure of claim 4, wherein each of the turn stopper pieces is formed in inverted T-shape.

10. The fuel injection valve supporting structure of claim 5, wherein each of said turn stopper pieces and said positioning piece extend in opposite directions from each other.

* * * * *